US009102435B1

(12) United States Patent
Garcia

(10) Patent No.: US 9,102,435 B1
(45) Date of Patent: Aug. 11, 2015

(54) HANGING INVERTED CONTAINER

(71) Applicant: Bernardo Garcia, Bellevue, WA (US)

(72) Inventor: Bernardo Garcia, Bellevue, WA (US)

( * ) Notice: Subject to any disclaimer, the term of this patent is extended or adjusted under 35 U.S.C. 154(b) by 0 days.

(21) Appl. No.: 14/307,327

(22) Filed: Jun. 17, 2014

(51) Int. Cl.
*B65D 1/02* (2006.01)

(52) U.S. Cl.
CPC ..... *B65D 1/0223* (2013.01); *B65D 1/023* (2013.01)

(58) Field of Classification Search
CPC ..... B65D 1/023; B65D 1/0223
USPC ..... 220/482, 324, 476, 480, 481, 694, 703; 215/399, 386, 387, 390, 395
See application file for complete search history.

(56) References Cited

U.S. PATENT DOCUMENTS

| | | | | | |
|---|---|---|---|---|---|
| 2,798,230 | A * | 7/1957 | Bailey et al. | ..... | 4/227.1 |
| D196,390 | S * | 9/1963 | McDermott | ..... | D9/534 |
| 3,619,192 | A * | 11/1971 | Land et al. | ..... | 430/208 |
| 5,435,513 | A * | 7/1995 | Davis | ..... | 248/311.3 |
| 5,549,074 | A * | 8/1996 | Hui | ..... | 119/477 |
| 6,050,408 | A * | 4/2000 | Testa | ..... | 206/361 |
| 6,273,283 | B1 * | 8/2001 | Terrana et al. | ..... | 215/383 |
| 8,413,838 | B2 | 4/2013 | Miller | | |
| 2011/0247994 | A1 * | 10/2011 | Siciliano | ..... | 215/395 |
| 2013/0306664 | A1 * | 11/2013 | Miller | ..... | 220/737 |

* cited by examiner

*Primary Examiner* — Robert J Hicks
*Assistant Examiner* — Kareen Rush
(74) *Attorney, Agent, or Firm* — Seed IP Law Group PLLC

(57) ABSTRACT

A container for holding and dispensing liquids into a beverage receptacle containing a beverage is disclosed. The container may include a body including an exterior wall and an interior cavity for holding liquid. The container may also include a neck having an interior cavity, the neck extending from the body at a shoulder region and having an exterior surface and a mouth through which to dispense the liquid into the beverage receptacle. The container may also include at least one extension extending from the shoulder region toward the mouth and having a distal end and an inner surface facing toward the neck. The inner surface of the at least one extension and the exterior surface of the neck may form a channel for receiving a rim of the beverage receptacle such that the container may hang from the rim of the beverage receptacle and dispense liquid into the beverage.

20 Claims, 3 Drawing Sheets

HANGING INVERTED CONTAINER

BACKGROUND

1. Technical Field

This disclosure relates to containers for dispensing liquids. More particularly, this disclosure relates to hanging inverted containers for dispensing liquids in mixed drinks and cocktails.

2. Description of the Related Art

Mixed drinks and cocktails are a lucrative product for bars and restaurants. A bartender or other member of a restaurant or bar's waitstaff typically makes or creates a mixed drink using spirits, wines, beers, and other ingredients behind a bar or otherwise away from their patron's tables. After making the drink, a bartender or server may present the completed drink to the patron.

A recent phenomenon has occurred where mixed drinks or cocktails have incorporated bottled ingredients including additional alcoholic or non-alcoholic bottled beverages such that the additional alcoholic or nonalcoholic bottled beverages slowly leave the bottle and combine with the beverage in a drink glass or other beverage receptacle as the patron consumes the drink. Some of these drinks are made by simply inverting a beer, liquor, wine, or other bottle into a drink glass or other beverage receptacle that contains a partially mixed drink. Inverting a bottle into a glass or other beverage receptacle is not a reliable way to create these sorts of mixed drinks, because the bottles are unstable, the outsides of the bottles may be dirty, and they may contain paper labels or other decorations that are not designed to be wet. These paper labels and decorations may weaken or fall off the bottle when the bottle is submerged in the drink.

Moreover, bars and restaurants serve certain types of drinks in particularly shaped containers. As bartenders innovate and create new drinks, the drinks may be ideally served in a particularly shaped container that is not conducive to simply inverting a bottle and putting it in the drink container. For example, inverting a miniature spirits container in a beer stein would cause the miniature spirits container to drop to the bottom and be completely submerged in the container.

Some restaurants and bars may use bottle holders to hold the inverted bottle in a container. However these bottle holders require sourcing of many parts to create one drink, are susceptible to theft, and are cumbersome for bartenders and servers at restaurants and bars.

BRIEF SUMMARY

Embodiments described herein provide versatile containers which are particularly well suited to be suspended upside down from a rim of a beverage container, and can be securely coupled to beverage containers of many different sizes and shapes.

A container for holding and dispensing liquids into a beverage receptacle containing a beverage is disclosed. The container may include a body including an exterior wall and an interior cavity for holding liquid. The container may also include a neck having an interior cavity, the interior cavity of the neck being in fluid communication with the interior cavity of the body, the neck extending from the body at a shoulder region and having an exterior surface and a mouth through which to dispense the liquid into the beverage receptacle. The container may also include at least one extension extending in a longitudinal direction from the shoulder region toward the mouth of the neck and having a distal end and an inner surface facing toward the neck. The inner surface of the at least one extension and the exterior surface of the neck may form a channel for receiving a rim of the beverage receptacle. The channel may be sized and shaped so that the container is able to hang from the rim of the beverage receptacle and dispense liquid into the beverage.

Another container for holding and dispensing liquids is also disclosed. The container may include a body including an exterior wall and an interior for holding liquid. The container may also include a neck having an interior, the interior of the neck connected in fluid communication with the interior of the body, the neck extending from the body, connected to the body through a shoulder, and having a mouth. The container may also include a plurality of flexible extensions extending in a longitudinal direction from an exterior wall of the body and having a distal end and an interior surface. The interior surface of each of the plurality of extensions and an exterior surface of the neck may form a plurality of throats for receiving a rim of a cup.

DETAILED DESCRIPTION

In the following description, certain specific details are set forth in order to provide a thorough understanding of various embodiments of the invention. However, one skilled in the art will understand that the invention may be practiced without these details. In other instances, well-known structures and steps associated with containers have not been shown or described in detail to avoid unnecessarily obscuring descriptions of the embodiment of the invention.

Figure 1:
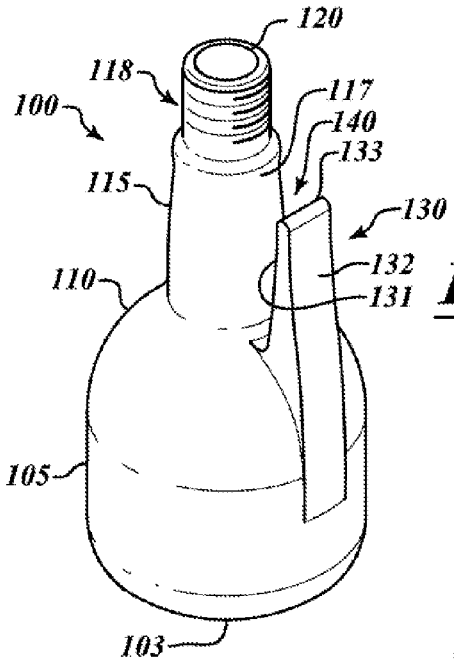
FIG. 1 shows an isometric view of a hanging inverted container according to one example embodiment.
Figure 3:
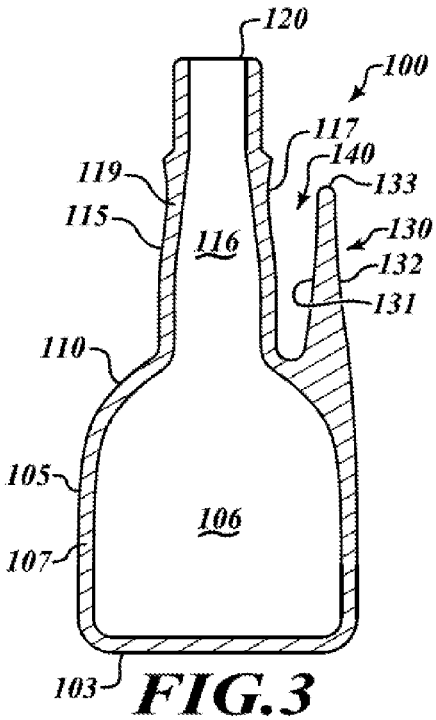
FIG. 3 shows a cross-sectional view of the hanging inverted container of FIG. 1.

FIG. 1 shows an embodiment of an inverted hanging bottle in an upright position. The container 100 includes a base 103, a body 105, a shoulder 110, and a neck 115. The base 103 allows the bottle to sit upright on a flat surface, for example, for storage, when otherwise not in use, or for filling with liquid or other material for use in mixed drinks. The body 105 may include an exterior wall 107 (FIG. 3) that may define an interior cavity or body cavity 106 (FIG. 3) for holding liquids and other material for use in mixed drinks. The body 105 may have a substantially round shape as shown in FIG. 1, or in some embodiments, the body 105 may have other shapes. For example, the body 105 may be substantially square in cross section, may have a substantially pyramidal, cylindrical, rectangular, or other shape.

The container 100 may include a shoulder or shoulder region 110 that couples the body 105 to a neck 115. The shoulder or shoulder region 110 may transition from a relatively large diameter or cross-section of the body 105 to a relatively narrow diameter or cross-section of the neck 115. In some embodiments, a container may have a substantially uniform cross-section between the body, the neck, and the shoulder, in such embodiments, the shoulder may be indistinguishable from the body and the neck. In some embodiments, a container may not include a shoulder region.

The neck 115 of the container 100 connects to the shoulder 110 or body 105 at a proximal end and a mouth 120 at a distal end. In some embodiments, for example when a restaurant or bar wishes to pre-fill the container 100 or when a distributor or manufacturer fills the container 100 and then transports it for sale, the distal end of the neck 115 may also include a coupling 118 for securing a cap or other device for closing the mouth 120 of the container 100. In some embodiments, the coupling 118 may be threads or a crown bead In some embodiments, for example when the bar or restaurant or other user of the container 100 wishes to only temporarily fill the container 100, the distal end of the neck 115 may not include a coupling 118. For example, in some embodiments, the bartender may fill the container 100 and then immediately put it to use, therefore, a coupling may not be useful or necessary.

The neck 115 may also include an exterior wall 119 that may define an interior cavity or neck cavity 116. The neck cavity 116 couples the body cavity 106 in fluid communication with the mouth 120 and facilitates fluid flow between the body cavity 106 and the mouth 120.

The container 100 may also include an extension 130. The extension 130 may project from the shoulder region 110 of the container 100. In some embodiments, the extension 130 may project from one or more of the neck 115, the shoulder region 110, or the body 105. As shown in FIG. 1, the extension 130 may project from the shoulder region 110 in a substantially axial direction along the longitudinal axis X (FIG. 4) of the container 110.

The extension 130 may include a radially inner surface 131 and a radially outer surface 132. The radially inner surface 131 may face an exterior surface 117 of the neck 115 of the container 100.

The inner surface 131 of the extension 130 and the exterior surface 117 of the neck 115 may form a channel 140 between the neck 115 and the extension 130. The channel 140 may be configured to receive the rim of a glass or other beverage receptacle when the container 100 is oriented in an inverted position.

Figure 2:
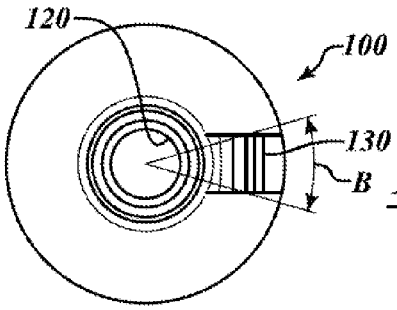
FIG. 2 shows top view of the hanging inverted container of FIG. 1.

The extension 130 is sized and shaped, or otherwise configured, such that the channel 140 between the extension 130 and the neck 115 securely holds the container 100 on the rim of a glass or other beverage receptacle. As shown in FIG. 2, the extension 130 may have an angular width B. The angular width B of the extension 130 may be configured such that the channel 140 grips the rim or sidewall of a glass or other beverage receptacle along an arc wide enough to stabilize the container 100 on the rim of a glass or other beverage receptacle. The extension 130 depicted in FIG. 2 has an angular width of about 15 degrees. In some embodiments, the angular width B of the extension 130 may range from a low of about 10, 15, 20, or 25 degrees to a high of about 15, 20, 25, 30, 45, or 60 degrees.

Figure 5:
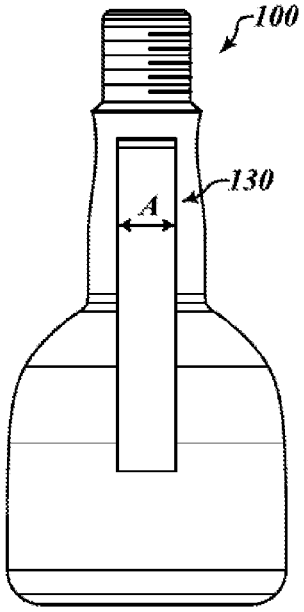
FIG. 5 shows front view of the hanging inverted container of FIG. 1.

As shown in FIG. 5, the extension 130 may have a width A. According to some embodiments, the width A of the extension 130 may range from a low of about 0.125, 0.25, 0.33, 0.5, 0.75, 1.0, or 1.5 inches to a high of about 0.25, 0.33, 0.5, 0.75, 1.0, 1.5, or 2.0 inches.

Although the illustrated extension 130 is depicted as having a substantially similar width along the length of the extension 130, in some embodiments, the width may vary along the length of the extension 130. For example, the extension 130 may be wider at the base (where the extension 130 meets the shoulder 110) than at a distal end 133.

Although the inner surface 131 and exterior surface 132 of the illustrated extension 130 are depicted as being substantially flat surfaces, in some embodiments, the inner surface 131 and exterior surface 132 may be curved, for example, they may be curved such that they match the curvature of the rim or sidewall of a glass or other beverage receptacle.

In some embodiments, the extension 130 may be integral with the body 105 from which it projects such that the extension 130, the body 105, and the neck 115 form a single, unitary structure of material. In some embodiments, the extension 130 may be coupled or affixed to the container 100 from which it projects. In some embodiments, the extension 130 may be substantially rigid, for example, the extension 130 may be made from glass. In some embodiments, the extension 130 may flex, for example, to pinch the wall of a glass or other beverage receptacle between the neck 115 and the extension 130.

In some embodiments, the extension 130 may project from a region of a container 100 that is not the shoulder 110. For example, the extension 130 may project from the body 105 or neck 115 of the container 100.

Figure 4:
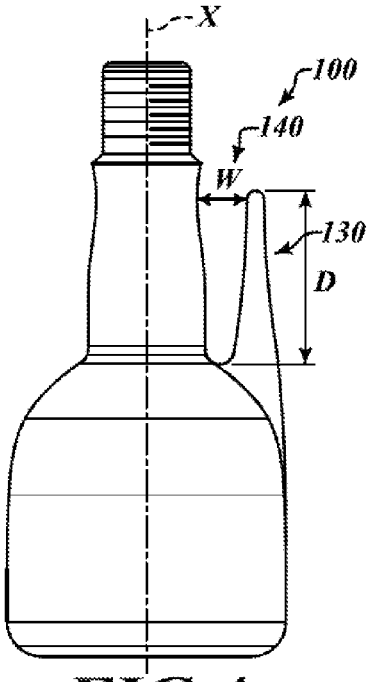
FIG. 4 shows side view of the hanging inverted container of FIG. 1.

As shown in FIG. 4, the channel 140 may have a width W and a depth D. The width W of the channel 140 may vary along the depth of the channel 140. By varying the width W of the channel 140 the container 100 may be configured to hang from glasses or other beverage receptacles with rims or sidewalls of varying thicknesses.

The channel 140 may be configured with a depth D. The depth D may be selected such that the container 100 securely grips the rim or sidewall of a glass or other beverage receptacle. According to some embodiments, the depth D of the extension 130 may range from a low of about 0.5, 0.75, 1.0, 1.5, 2.0, or 2.5 inches to a high of about 0.75, 1.0, 1.5, 2.0, 2.5, or 3.0 inches. In some embodiments, the depth D of the channel 140 may correspond to the length of the extension 130.

Figure 6:
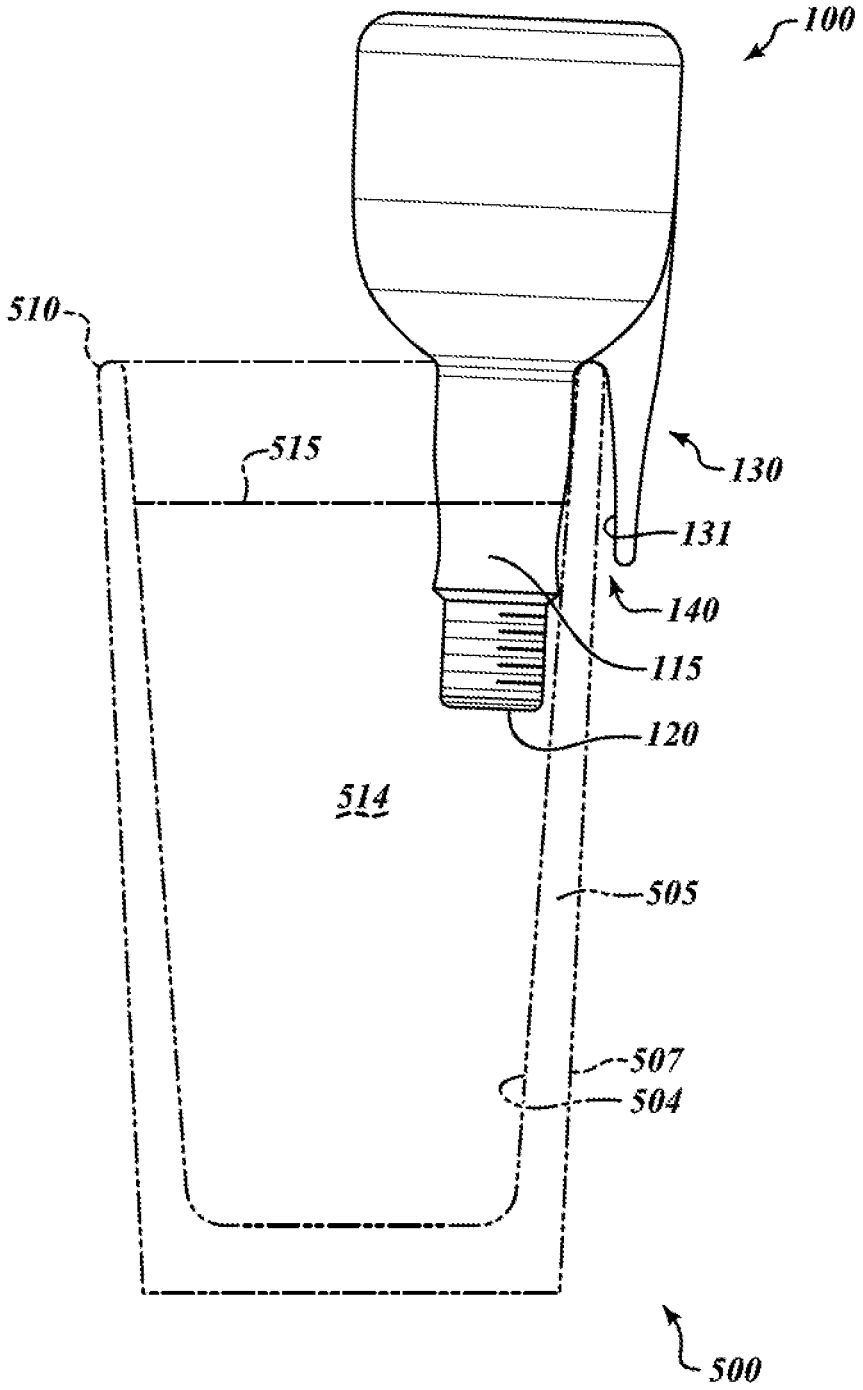
FIG. 6 shows a side view of the hanging inverted container of FIG. 1 in use within a glass.

FIG. 6 shows the container 100 in use hanging on a beverage receptacle, in particular a glass 500. The glass 500 may be filled with a mixed or partially mixed drink or other fluid 514 up to the surface 515. After the glass 500 is filled, the container 100, which also contains fluid, may be hung from a rim 510 of the glass 500 such that the mouth 120 is submerged in the fluid 514 within the glass 500. By submerging the mouth 120 within the fluid 514 the air pressure on the surface 515 of the fluid 514 acts on the fluid contained within the container 100 and helps prevent it from immediately emptying into the glass 500. In this way a restaurant or bar patron may finish mixing the drink by emptying the contents of the container 100 into the glass 500 at a slow rate.

As shown in FIG. 6, the channel 140 of the container 100 holds the container 100 on the rim 510 of the glass 500. A portion of the neck 115 may contact an inner surface 504 of the sidewall 505 of the glass 500 while the base and the inner surface 131 of the extension 130 contact the rim 510 and an outer surface 507 of the sidewall 505 of the glass 500.

Figure 7:
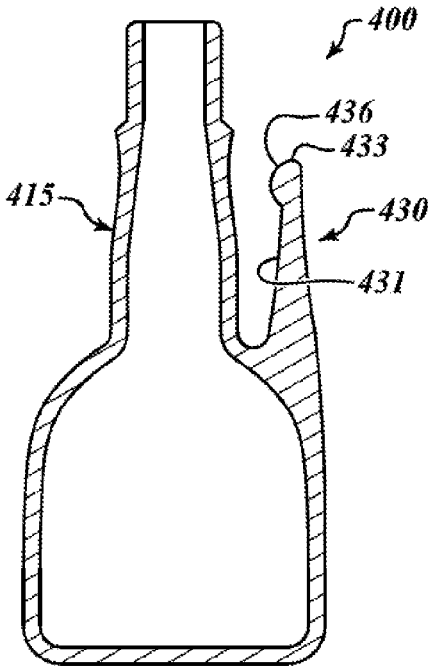
FIG. 7 shows a cross-sectional view of a hanging inverted container according to another example embodiment disclosed herein.

In some instances, the extension 130 or channel 140 may include an additional structure to facilitate holding the container 100 on the rim of the glass 500. For example, FIG. 7 depicts another embodiment of a container 400 having an extension 430 with a protrusion 436. The protrusion 436 extends radially inward from an inner surface 431 of a distal end 433 of the extension 430 towards the neck 415. The protrusion 436 provides an additional contact surface by which the extension 430 may contact the rim or sidewall of a glass or other beverage receptacle. The additional contact surface may help stabilize the container 400 while hanging inverted on the rim of the glass or other beverage receptacle.

Although the protrusion 436 is depicted as being integral to the extension 430, in some embodiments, the protrusion 436 may be adhered or otherwise coupled to the extension 430.

Figure 8:
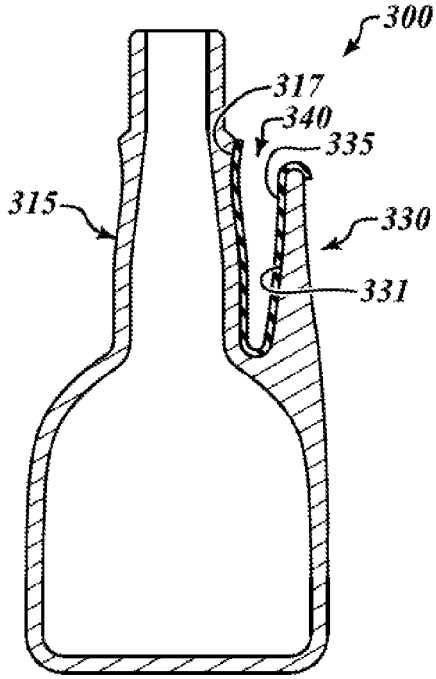
FIG. 8 shows a cross-sectional view of a hanging inverted container according to yet another example embodiment disclosed herein.

FIG. 8 shows another embodiment of an inverted hanging container 300, wherein a channel 340 is lined with a gripping element or liner 335. The liner 335 may have a higher friction coefficient or may be made from a softer material to reduce breakage and aid in holding the container 300 on the rim of a glass or other beverage receptacle.

In some instances, the inverted hanging container 300 may be made from glass. Contact points of a glass container 300 hanging on the rim of a beverage receptacle made from glass may be characterized as having a relatively low coefficient of friction. Moreover, glass on glass contact may cause either the container 300 or the beverage receptacle on which the container 300 is mounted to chip, crack, or otherwise break. Therefore, lining the channel 340, and in particular a surface 317 of a neck 315 and an inner surface 331 of an extension 330 with a liner 335 made from a higher friction or shock absorbing material, such as a polymer, may reduce the incidence of breakage of beverage receptacles and containers and may help the container 300 grip the rim or sidewall of the beverage receptacle on which it is hung.

In some embodiments, the liner 335 may extend around the distal end of the extension 330. Although depicted as extending along both the surface 317 of the neck 315 and the inner surface 331 of the extension 330, in some embodiments, the liner 335 may only cover a portion of the surface 317 of the neck 315 or the surface 331 of the extension 330, or the liner 335 may cover a portion of only one of the surface 317 of the neck 315 and the surface 331 of the extension 330.

Figure 9:
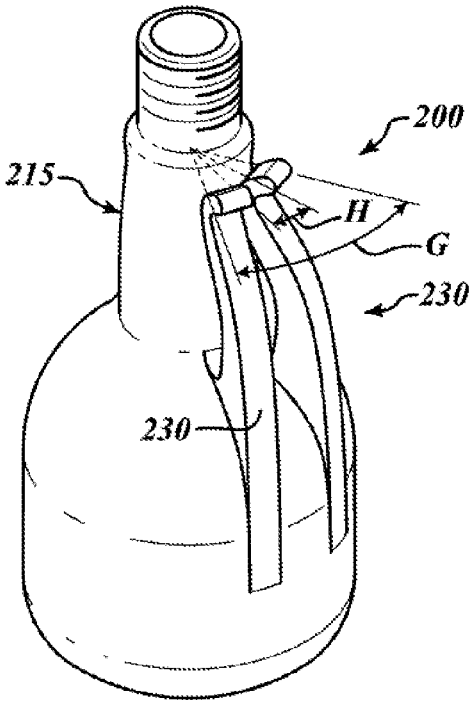
FIG. 9 shows an isometric view of a hanging inverted container according to still yet another example embodiment disclosed herein.
Figure 10:
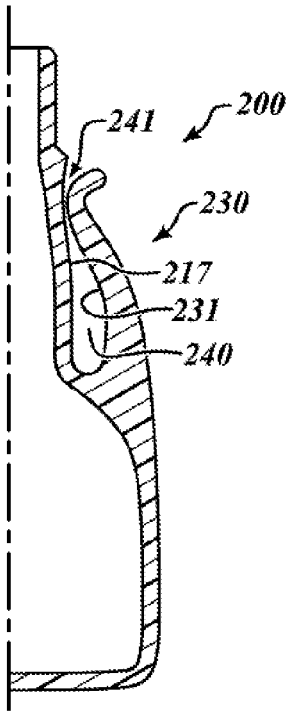
FIG. 10 shows a partial cross-sectional view of the hanging inverted container of FIG. 9.

FIGS. 9 and 10 depict another embodiment of an inverted hanging container 200 that includes two extensions 230. An outer surface 217 of a neck 215 and an inner surface 231 of the extensions 230 create a narrow channel or throat 240 for receiving the rim or sidewall of a cup or glass or other beverage receptacle.

Each extension 230 extends axially from the shoulder region of the container 200. Each extension 230 may then end radially inward toward the outer surface 217 of the neck 215 with the distal end of the extension 230 flaring radially outward from the neck 215 to form a ramp to guide the rim of the glass or other beverage receptacle into the channel or throat 240. In some embodiments, such as the embodiment depicted in FIGS. 9 and 10, the opening 241 of the channel or throat 240 may be narrower as compared to the rest of the channel or throat 240.

The channel or throat 240 may have a depth such that the mouth of the neck 215 is located at least one inch below the rim of a glass or other beverage receptacle when dispensing liquid therein. According to some embodiments, the neck location below the rim of the glass or other beverage receptacle when dispensing liquid therein may range from a low of about 0.5, 0.75, 1.0, 1.5, 2.0, or 2.5 inches to a high of about 0.75, 1.0, 1.5, 2.0, 2.5, 3.0, or more inches.

In some embodiments, the extensions 230 may be made from a flexible material. For example, the extensions 230 of FIGS. 9 and 10 may be made from a flexible material such that the narrow opening 241 of the channel or throat 240 may be widened when the container 200 is hung from the rim or sidewall of the glass or other beverage receptacle. The flexing of the extensions 230 may cause the distal end of the extension 230 to press against the rim or sidewall of the glass or other beverage receptacle causing the container 200 to more tightly grip the glass or other beverage receptacle.

In some embodiments, for example as depicted in FIG. 9, two or more extensions 230 may extend from the body or shoulder region of a container 200. In other embodiments, a single extension 230 may be provided. Using multiple extensions 230 spread widely apart, however, may allow the container 200 to more stably hang from a glass or other beverage receptacle while using less material than a similarly wide single extension.

As shown in FIG. 9, the extensions 230 may have an overall angular width G and may be separated by an angular width H. In some embodiments, the angular width H between the extensions 230 may range from a low of about 5, 10, 15, 20, 25, 35, 45, or 60 degrees to a high of about 10, 15, 20, 25, 30, 45, 60, or 90 degrees. In some embodiments, the overall angular width G may range from a low of about 5, 10, 15, 20, 25, 35, 45, or 60 degrees to a high of about 10, 15, 20, 25, 30, 45, 60, 90, 100, or more degrees.

Again, certain specific details are set forth herein in order to provide a thorough understanding of various embodiments of the invention. However, one skilled in the art will understand that embodiments of the invention may be practiced without these details. Moreover, aspects and features of the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A container for holding and dispensing liquids into a beverage receptacle containing a beverage, the container comprising:

a body including an exterior wall and an interior cavity for holding liquid;

a neck having an interior cavity, the interior cavity of the neck being in fluid communication with the interior cavity of the body, the neck extending from the body at a shoulder region of the container and having an exterior surface and a mouth through which to dispense the liquid into the beverage receptacle, the shoulder region including a shoulder; and at least one extension extending in a longitudinal direction from the exterior wall of the body at the shoulder toward the mouth of the neck and having a distal end and an inner surface facing toward the neck, the inner surface of the at least one extension and the exterior surface of the neck forming a channel for receiving a rim of the beverage receptacle, the channel being sized and shaped so that the container is able to hang from the rim of the beverage receptacle and dispense liquid into the beverage.

2. The container of claim 1 wherein the body, the neck, and the at least one extension are integrally formed as a single, unitary structure of material.

3. The container of claim 1 wherein the distal end of the at least one extension includes a protrusion extending towards the neck.

4. The container of claim 1, further comprising:

a gripping element affixed to the neck and an interior surface of the at least one extension.

5. The container of claim 1 a width of the at least one extension is between about 0.5 inch to about 1.0 inch.

6. The container of claim 1 wherein a base of the at least one extension has an angular width between about 15 degrees to about 45 degrees.

7. The container of claim 1 wherein the at least one extension is flexible.

8. The container of claim 1 wherein the container includes a pair of extensions extending in a longitudinal direction from the shoulder region toward the mouth of the neck and each of the pair of extensions having a distal end and an inner surface facing toward the neck, the inner surfaces of the each of the pair of extensions and the exterior surface of the neck forming a channel for receiving a rim of the beverage receptacle, the channels being sized and shaped so that the container is able to hang from the rim of the beverage receptacle and dispense liquid into the beverage.

9. The container of claim 1 wherein the distal end of the at least one extension includes a ramped surface configured to guide the rim of the beverage receptacle into the channel.

10. The container of claim 1 wherein the neck is narrower than the body.

11. A container for holding and dispensing liquids, the container comprising:

a body including an exterior wall and an interior for holding liquid;

a neck having an interior, the interior of the neck connected in fluid communication with the interior of the body, the neck extending from the body, connected to the body through a shoulder, and having a mouth;

a plurality of flexible extensions extending in a longitudinal direction from the exterior wall of the body and having a distal end and an interior surface; and the interior surface of each of the plurality of extensions and an exterior surface of the neck forming a plurality of throats for receiving a rim of a cup.

12. A container for holding and dispensing liquids according to claim 11 wherein a width of each of the plurality of flexible extension is between about 0.125 inch to about 0.33 inch.

13. The container of claim 11 wherein an adjacent pair of the plurality of flexible extensions has an angular separation of between about 5 degrees.

14. The container of claim 11 wherein an adjacent pair of the plurality of flexible extensions has an angular separation of between about 5 degrees to about 30 degrees.

15. The container of claim 11 wherein at least one of the plurality of flexible extensions includes a protrusion extending towards the neck.

16. The container of claim 11 wherein the body, the neck, and the at least one extension are integrally formed as a single, unitary structure of material.

17. The container of claim 11 wherein the one of the plurality of throats is configured to have a depth such that the mouth of the neck is located at least one inch below the rim of a of beverage receptacle when dispensing liquid therein.

18. The container of claim 11 wherein a distal end of one of the plurality of extensions includes a ramped surface configured to guide the rim of a cup into the throat.

19. The container of claim 11 wherein the next is narrower than the body.

20. The container of claim 11 wherein at least one of the a plurality of flexible extensions is flexible.

* * * * *